US012214848B2

(12) United States Patent
Grimaldi

(10) Patent No.: US 12,214,848 B2
(45) Date of Patent: Feb. 4, 2025

(54) TELESCOPIC GANGWAY

(71) Applicant: OPACMARE S.R.L., Turin (IT)

(72) Inventor: Michele Grimaldi, Piossasco (IT)

(73) Assignee: OPACMARE S.R.L., Turin (IT)

( * ) Notice: Subject to any disclaimer, the term of this patent is extended or adjusted under 35 U.S.C. 154(b) by 666 days.

(21) Appl. No.: 17/548,665

(22) Filed: Dec. 13, 2021

(65) Prior Publication Data

US 2022/0185433 A1 Jun. 16, 2022

(30) Foreign Application Priority Data

Dec. 14, 2020 (IT) ..... 102020000030689

(51) Int. Cl.
*B63B 27/14* (2006.01)

(52) U.S. Cl.
CPC ..... *B63B 27/14* (2013.01); *B63B 2027/141* (2013.01)

(58) Field of Classification Search
CPC .... B63B 17/04; B63B 2027/141; B63B 27/14
See application file for complete search history.

(56) References Cited

U.S. PATENT DOCUMENTS 4,168,764 A * 9/1979 Walters ..... B63B 27/14 182/1
7,393,173 B2 * 7/2008 Mathys ..... B65G 1/0435 414/266
9,546,458 B1 * 1/2017 Willard ..... B60R 3/005
2008/0163571 A1 * 7/2008 Kohler ..... E04F 11/04 248/220.22

(Continued)

FOREIGN PATENT DOCUMENTS

EP 3075647 A1 10/2016
EP 3461733 A1 4/2019

(Continued)

OTHER PUBLICATIONS

Search Report for IT202000030689 dated Sep. 16, 2021, The Hague, NL.

*Primary Examiner* — Gary S Hartmann
(74) *Attorney, Agent, or Firm* — ArentFox Schiff LLP; Michael Fainberg

(57) ABSTRACT

A gangway has a proximal gangway element, a distal gangway element, a distal stanchion hinged to the distal gangway element, and a distal stanchion control mechanism for converting sliding movement of the distal gangway element into rotational movement of the distal stanchion. The distal stanchion control mechanism has a spring associated with the distal stanchion and configured to bias the distal stanchion towards a raised terminal position, a return bracket slidably mounted to the distal gangway element, and a cam member rotationally integral with the distal stanchion and configured to engage the return bracket. With the distal gangway element in the retracted terminal position, the return bracket abuts against a distal end of the proximal gangway element and is located in a distal terminal position relative to the distal gangway element. Raising of the distal stanchion is caused by movement of the distal gangway element relative to the return bracket.

7 Claims, 4 Drawing Sheets

(56) References Cited

U.S. PATENT DOCUMENTS

| | | | | |
|---|---|---|---|---|
| 2012/0175187 | A1* | 7/2012 | Baker | E06C 7/143<br>182/106 |
| 2013/0047910 | A1* | 2/2013 | Mueller | B63B 27/146<br>114/343 |

FOREIGN PATENT DOCUMENTS

| | | | | |
|---|---|---|---|---|
| EP | 3822157 | A1 * | 5/2021 | B63B 27/14 |
| WO | 2013/042157 | A1 | 3/2013 | |

* cited by examiner

TELESCOPIC GANGWAY

CROSS-REFERENCE TO RELATED APPLICATION

This application claims priority to and benefit of Italian Patent Application No. 102020000030689 filed Dec. 14, 2020, the contents of which are incorporated by reference in their entirety.

FIELD OF THE INVENTION

The present invention relates in general to motorized telescopic gangways, which are used for example on boats.

BACKGROUND OF THE INVENTION

Gangways of this kind generally comprise at least two gangway elements, more specifically a proximal gangway element and a distal gangway element which is inserted into the proximal gangway element and is slidable in a telescopic manner relative thereto between a retracted terminal position and an extended terminal position.

In general, the gangways (telescopic or not) may be provided with so-called stanchions, i.e. support posts for ropes or cables that are used as a bearing or support aid for users.

These stanchions may be fixed, mounted on the gangways at the time of their use, or may be provided with systems for controlling their handling from a lying rest position to an upright use position. A gangway provided with a control system for moving the stanchions is described for example in WO 2013/042157 A1.

SUMMARY OF THE INVENTION

The object of the present invention is to provide a system for controlling stanchions that is suitable for telescopic gangways. In particular, an object of the invention is to provide a control system which is compact and efficient.

The subject matter of the invention is therefore a gangway comprising

- a proximal gangway member and a distal gangway member which is inserted into the proximal gangway member and slidable in a telescopic manner relative thereto, between a retracted terminal position and an extended terminal position,
- a distal stanchion hinged at a distal end of the distal gangway element, said distal stanchion being rotatable relative to the distal gangway element between a lowered terminal position and a raised terminal position, and
- a distal stanchion control mechanism configured to convert a sliding motion of the distal gangway element into a rotational motion of the distal stanchion, characterized in that the distal stanchion control mechanism comprises

- elastic means associated to the distal stanchion and configured to bias the distal stanchion from the lowered terminal position towards the raised terminal position,
- a return bracket mounted to the distal gangway element for a sliding motion between a proximal terminal position and a distal terminal position relative to the distal gangway element, and
- a cam member rotationally integral with the distal stanchion and configured to engage the return bracket by action of said elastic means, in such a way that the return bracket is biased from the distal terminal position towards the proximal terminal position, wherein when the distal gangway element is in its retracted terminal position, the return bracket is in abutment against a distal end of the proximal gangway element and is in its distal terminal position relative to the distal gangway element, and raising of the distal stanchion is caused by a motion of the distal gangway element relative to the return bracket.

In the aforesaid gangway, the control mechanism of the distal stanchion is made with few components, which may be sized in such a way as to have a relatively small footprint.

BRIEF DESCRIPTION OF THE FIGURES

Further features and advantages of the gangway according to the invention will become clearer from the following detailed description of an embodiment of the invention, made with reference to the accompanying drawings, provided purely for illustrative and non-limiting purposes, in which.

DETAILED DESCRIPTION

Figure 1:
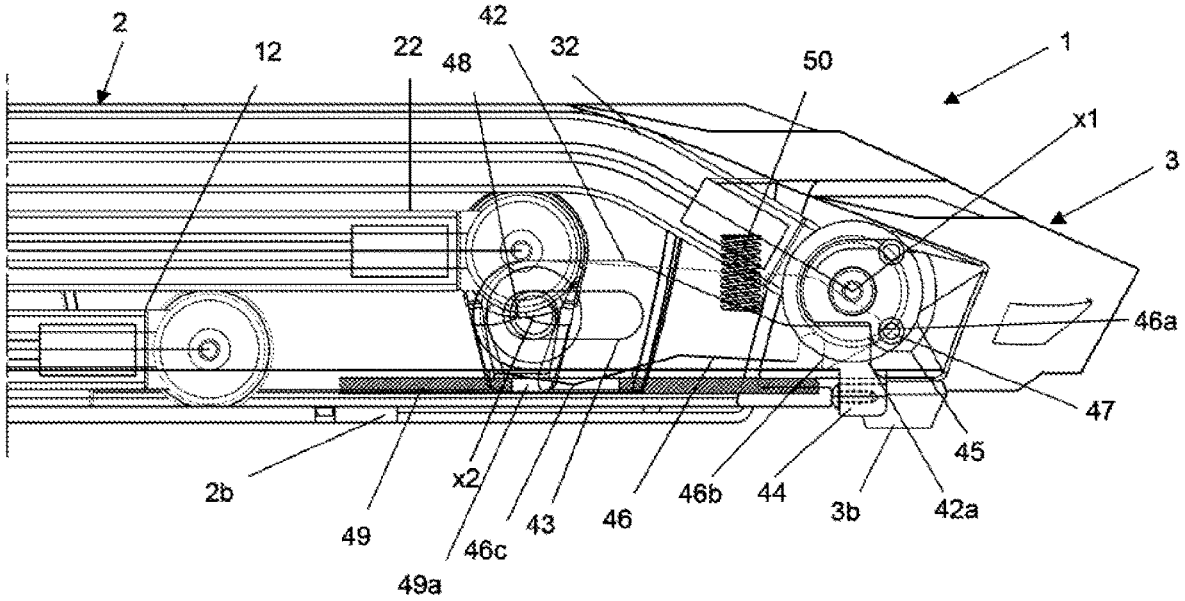
FIG. 1 is a side elevation view of a gangway according to the present invention, with a distal gangway element in the retracted terminal position.

With reference to the figures, a telescopic gangway is shown, indicated as a whole with reference numeral 1. The gangway may be installed on board a vehicle, in particular on board a boat.

Figure 6:
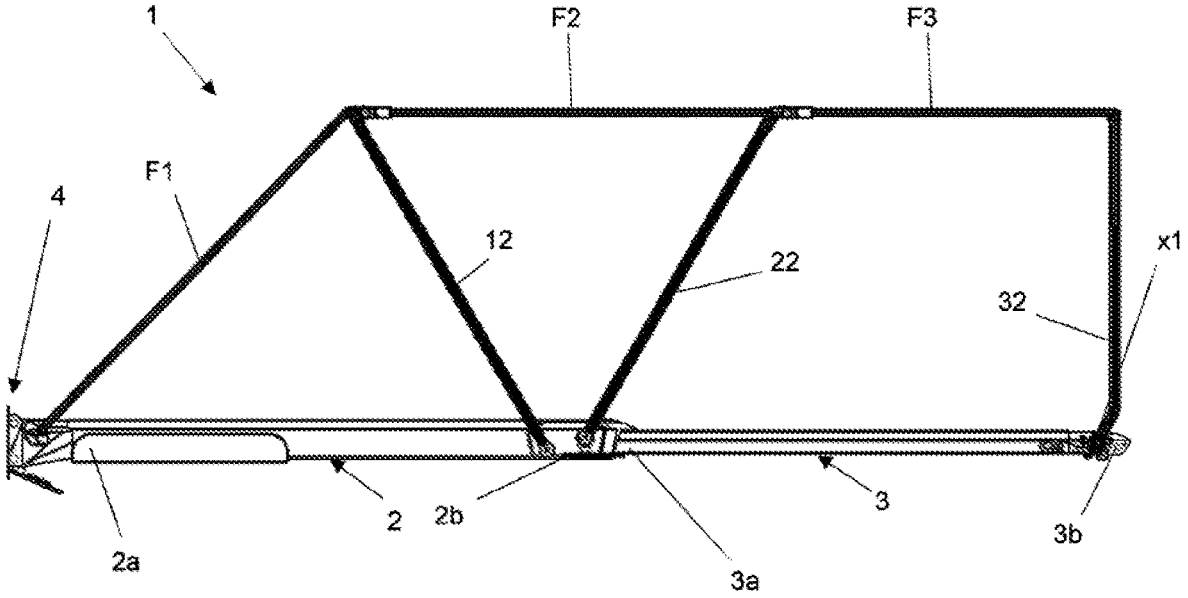
FIG. 6 is an overall side elevation view of the gangway of FIG. 1 with the gangway element in the extended terminal position.

The gangway 1 comprises a proximal gangway element 2 and a distal gangway element 3 inserted into the proximal gangway element 2 and slidable in a telescopic manner relative thereto, between a retracted terminal position, shown in FIG. 1, and an extended or extracted terminal position, shown in FIG. 6.

The proximal gangway member 3 may also be provided with its own motions, for example rotational motions. The proximal gangway element may be an element having a telescopic movement relative to a further gangway element or, as in the example illustrated, to a housing seat indicated with reference numeral 4. The housing seat 4 is configured to be fixed to the structure of a boat. The handling of the gangway members is controlled by a control system and actuators in a manner which is known per se and not essential for the purposes of the present invention. According to an embodiment, the proximal gangway element may simply be a housing seat configured to be fixed to the structure of a boat.

The proximal gangway element 2 comprises a proximal end 2*a* and a distal end 2*b*. The distal gangway element 3 comprises a proximal end 3*a* and a distal end 3*b*. For the purposes of the present description, the terms "proximal" and "distal" refer to the sliding direction of the distal gangway element 3, corresponding to the longitudinal direction of the gangway. The term "proximal" means "closer" to the vehicle on which the gangway 1 is installed.

Figure 4:
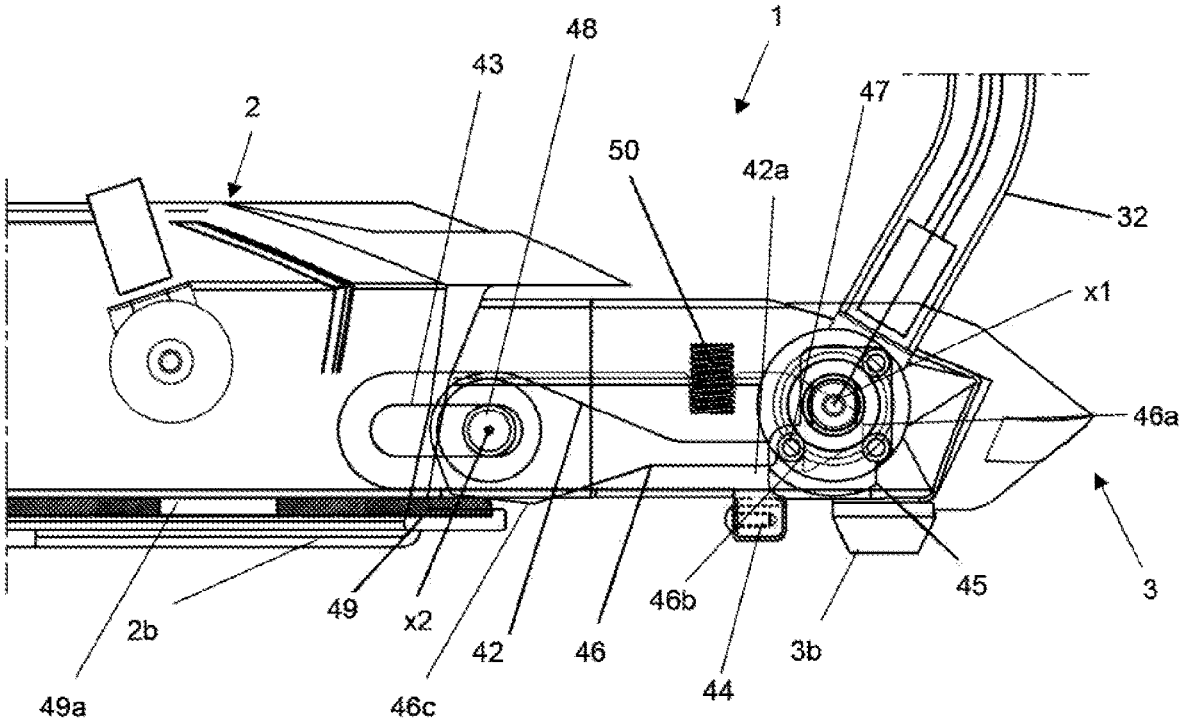
FIG. 4 is a side elevation view of the gangway of FIG. 1 with the distal gangway element in an intermediate position, more distant from the retracted terminal position than the position of FIGS. 2 and 3, and the distal stanchion in the raised terminal position.

The gangway 1 further comprises a plurality of stanchions which may be rotated between a lowered or extended terminal position (substantially parallel to the gangway 1 as shown in FIG. 1) and a raised or upright terminal position (shown in FIGS. 4 and 6).

In particular, the gangway 1 comprises a proximal stanchion 12 and an intermediate stanchion 22 hinged at the distal end 2*b* of the proximal gangway element 2, and a distal stanchion 32 hinged at the distal end 3*b* of the distal gangway element 3. The rotation axis of the distal stanchion 32 is indicated in the figures with x1, while the rotation axes of the proximal and intermediate stanchions 12, 22, not shown in the figures, are parallel to the rotation axis x1.

The gangway 1 further comprises a distal stanchion control mechanism configured to convert a sliding movement of the distal gangway element 3 relative to the proximal gangway element 2 into a rotational movement of the distal stanchion 32 relative to the distal gangway element 3. The components of the control mechanism are contained inside the gangway 1, but for the sake of simplicity they are represented in the figures as if they were visible from the outside.

The distal stanchion control mechanism comprises a torsional spring 41 positioned on the rotation axis x1 of the distal stanchion 32 (shown in FIG. 3), which is configured to bias the distal stanchion 32 from the lowered terminal position towards the raised terminal position. As an alternative to the torsional spring 41 it is possible to provide other elastic means associated with the distal stanchion 32.

The distal stanchion control mechanism further comprises a return bracket 42 slidably mounted to the distal gangway element 3. The return bracket 42 slides with respect to the distal gangway element 3, between a proximal terminal position and a distal terminal position. In particular, the return bracket 42 slides along a direction parallel to the sliding direction of the proximal gangway element 3 (horizontal in the figures).

The return bracket 42 comprises a proximal portion, in which a slot 43 is formed, extending in the sliding direction of the return bracket 42, the purpose of which will be described hereinafter, and a distal portion, on one end 42*a* of which an abutment 44 is formed, projecting downwards, the purpose of which will also be described hereinafter. As may be seen in the figures, the distal end 42*a* of the return bracket 42 is arranged in proximity to the rotation axis x1 of the distal stanchion 32.

The distal stanchion control mechanism also comprises a cam member 45 rotationally integral with the distal stanchion 32. The cam member 45 is arranged in proximity to the distal end 42*a* and is configured to engage the return bracket 42 by effect of the elastic force exerted by the torsional spring 41. In this way, the return bracket 42 is biased in a direction that goes from its distal terminal position towards its proximal terminal position.

The arrangement described above is such that, when the distal gangway element 3 is in its retracted terminal position (FIG. 1), the return bracket 42 abuts against the distal end 2*b* of the proximal gangway element 2 and is located in its distal terminal position relative to the distal gangway element 3. In this condition, the raising of the distal stanchion 32 is caused by a movement of the distal gangway element 3 relative to the return bracket 42.

The stanchion control mechanism further comprises a latching lever 46 hinged to the distal gangway element 3. The rotation axis of the latching lever 46 is indicated with x2 in the figures, and is parallel to the rotation axis x1 of the distal stanchion 32. A distal end of the latching lever 46 is arranged in proximity to the rotation axis x1 of the distal stanchion 32. A locking tip 46*a* and a coupling recess 46*b* are formed on the distal end. By such means, the latching lever 46 is operatively associated with a stop element 47 rotationally integral with the distal stanchion 32.

Figure 3:
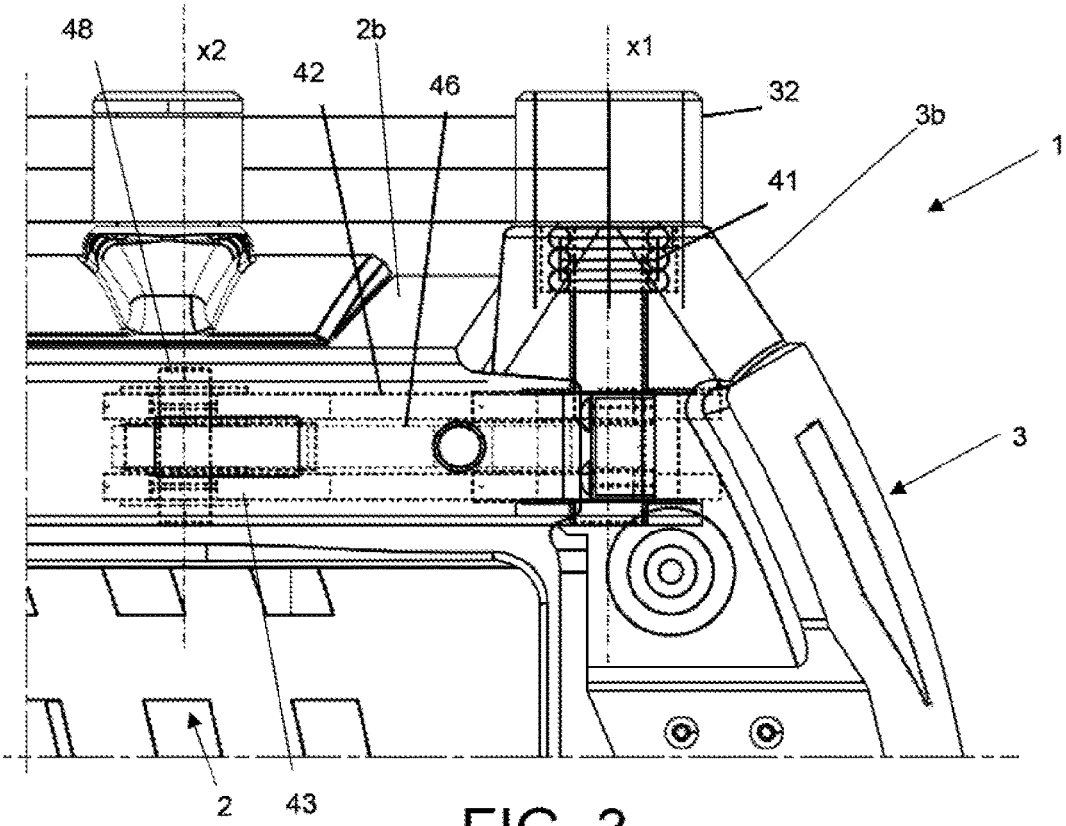

As shown in FIG. 3, the return bracket 42 and the latching lever 46 are arranged side by side in the direction of the rotation axis x2 of the latching lever 46; consequently, the cam member 45 and the stop member 47 are arranged offset relative to each other in the direction of the rotation axis x1 of the distal stanchion 32. More precisely, in the example illustrated the return bracket 42 comprises two parallel plates, between which the latching lever 46 is interposed. The latching lever 46 is hinged to the distal gangway element 3 through a hinge pin 48, which passes through the slot 43 formed in the return bracket 42. The measures described above contribute, on the one hand, to obtaining a particularly compact structure and, on the other hand, to defining a guide for the return bracket 42.

The latching lever 46 may be controlled by driving means 49 integral with the proximal gangway element 2 in such a way to engage the stop element 47 at the lowered terminal position and the raised terminal position of the distal stanchion 32, and release the stop elements 47 in intermediate positions between the lowered terminal position and the raised terminal position of the distal stanchion 32. The latching lever 46 is biased against the driving means 49 by a helical spring 50.

In particular, the latching lever 46 comprises a follower portion 46*c* and the driving means 49 consist of a variable profile guide with which the follower portion 46*c* of the latching lever 46 cooperates to control the latching lever 46. In the example illustrated, the variable profile guide comprises a slot 49*a*.

The stanchions 12, 22, 32 are connected to each other by pieces of rope F1, F2, F3 which act as handrails. Advantageously, it is an elastic rope, arranged in such a way that with the stanchions lowered, the excess rope collects inside the stanchions, which have a tubular structure for this purpose (see FIGS. 5 and 6).

The extraction motion, i.e. from the retracted position to the extended position, of the distal gangway member 3 is controlled by the control system of the gangway in a manner known per se.

FIG. 1 illustrates the gangway with the distal gangway element 3 in its retracted terminal position and the stanchions 12, 22, 32 in their lowered terminal position.

In this condition, the distal stanchion 32 is kept in the lowered terminal position because the return bracket 42 which engages the cam member 45 and the latching lever 46 which engages the stop member 47 through the tip 46*a* block the rotation of the cam member 45. The latching lever 46 is held in position by the spring 50 which pushes it towards the variable profile guide 49.

Figure 2:
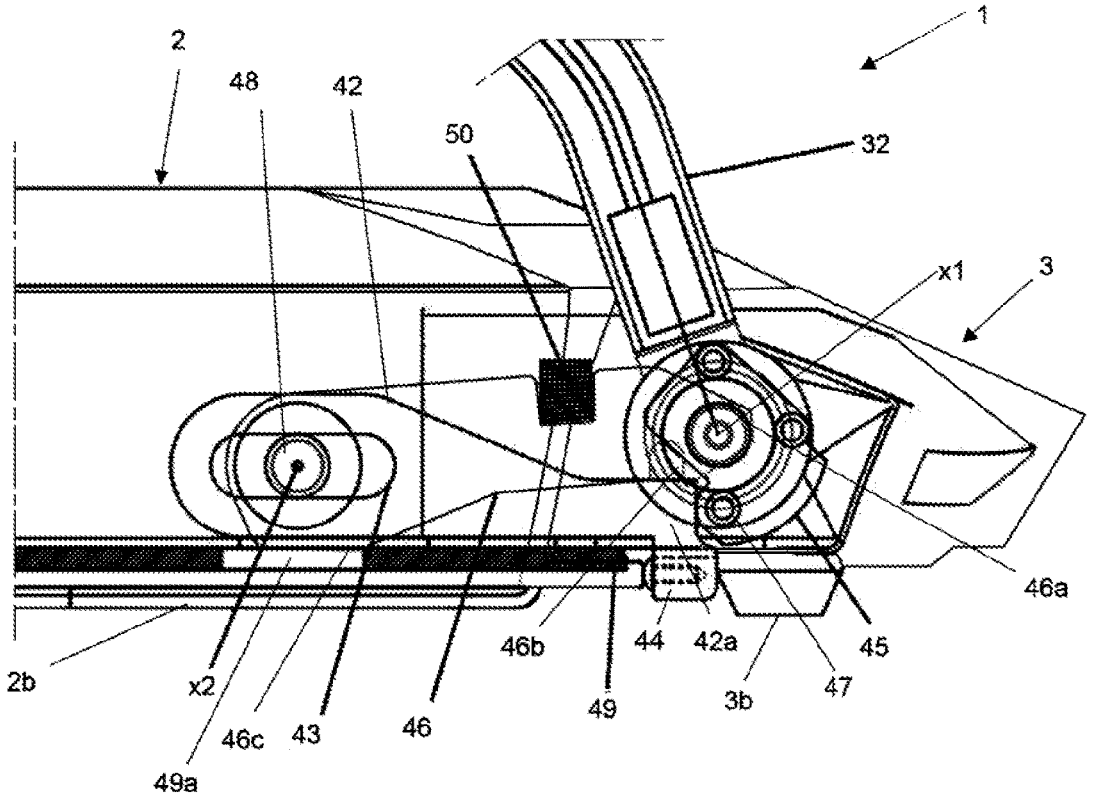
FIGS. 2 and 3 are a side elevation view and a plan view, respectively, of the gangway of FIG. 1, with the distal gangway element in an intermediate position close to the retracted terminal position and a distal stanchion in a partially raised position.

When the distal gangway element 3 starts the movement, the condition of FIG. 2 applies. In this position, the movement on the variable profile guide 49 integral with the proximal gangway element 2 forces the latching lever 46 to rotate around the axis x2, compressing the spring 50. This movement releases the rotation of the cam member 45. The torsional spring 41 (FIG. 3), located on the rotation axis x1 of the distal stanchion 32, gives the distal stanchion 32 the rotational movement which causes it to rise.

In FIG. 4, the distal gangway element 2 is further advanced to allow the distal stanchion 32 to reach its raised terminal position. The return bracket 42, which has reached its proximal terminal position with respect to the distal gangway element 3, prevents the terminal stanchion 32 from going beyond the point of maximum opening. When the latching lever 46 comes out of the variable profile guide 49, the spring 50 brings the locking lever 46 back to the low position and engages it on the stop element or pin 47 integral with the cam member 45, locking the distal stanchion 32 in its raised terminal position.

Figure 5:
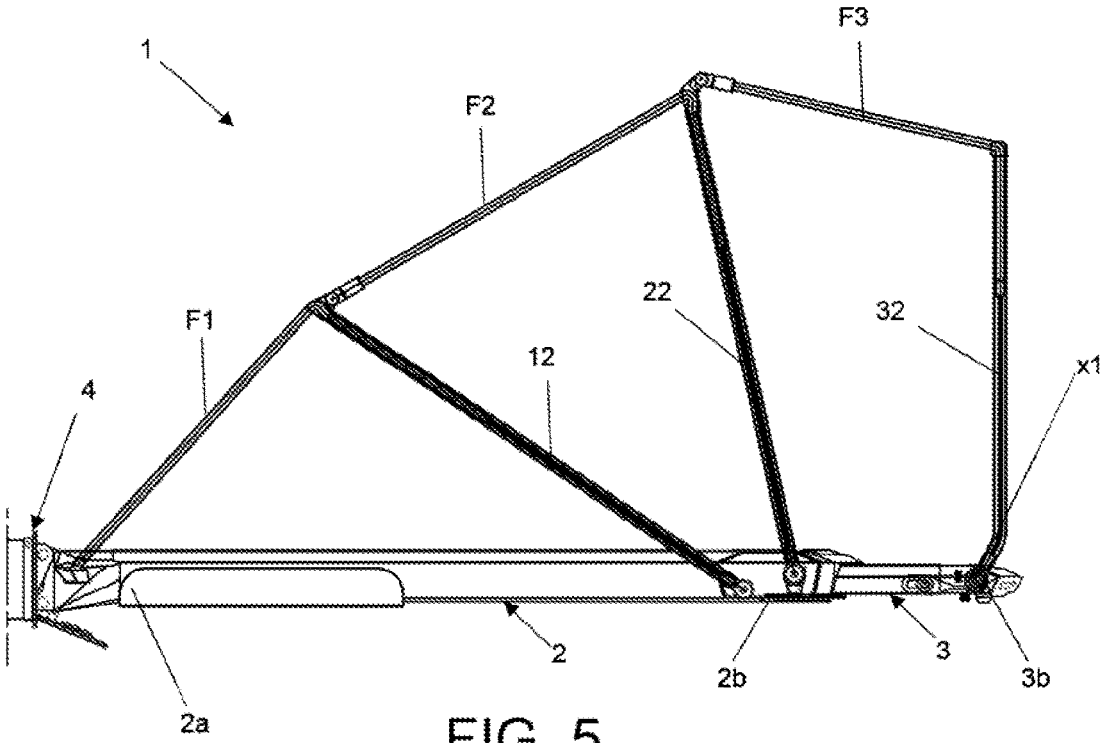
FIG. 5 is an overall side elevation view of the gangway of FIG. 1 with the gangway element in an intermediate position, more distant from the retracted terminal position with respect to the position of FIG. 4.

As explained, the stanchions 12, 22, 32 are connected to each other by an elastic rope housed inside the stanchions. The raising of the distal stanchion 32, pushed by the torsional spring 41, by the elastic ropes F1, F2, F3, drives the proximal stanchion 12 and the intermediate stanchion 22 to open (FIG. 5). The opening of the stanchions is completed when reaching the extended terminal position of the distal gangway element 3 (FIG. 6).

In the retraction movement, from the extended position to the retracted position, the sequence of movements described above is reversed; the proximal stanchion 12 and the intermediate stanchion 22 are lowered while the distal stanchion 32 remains raised.

Figure 7:
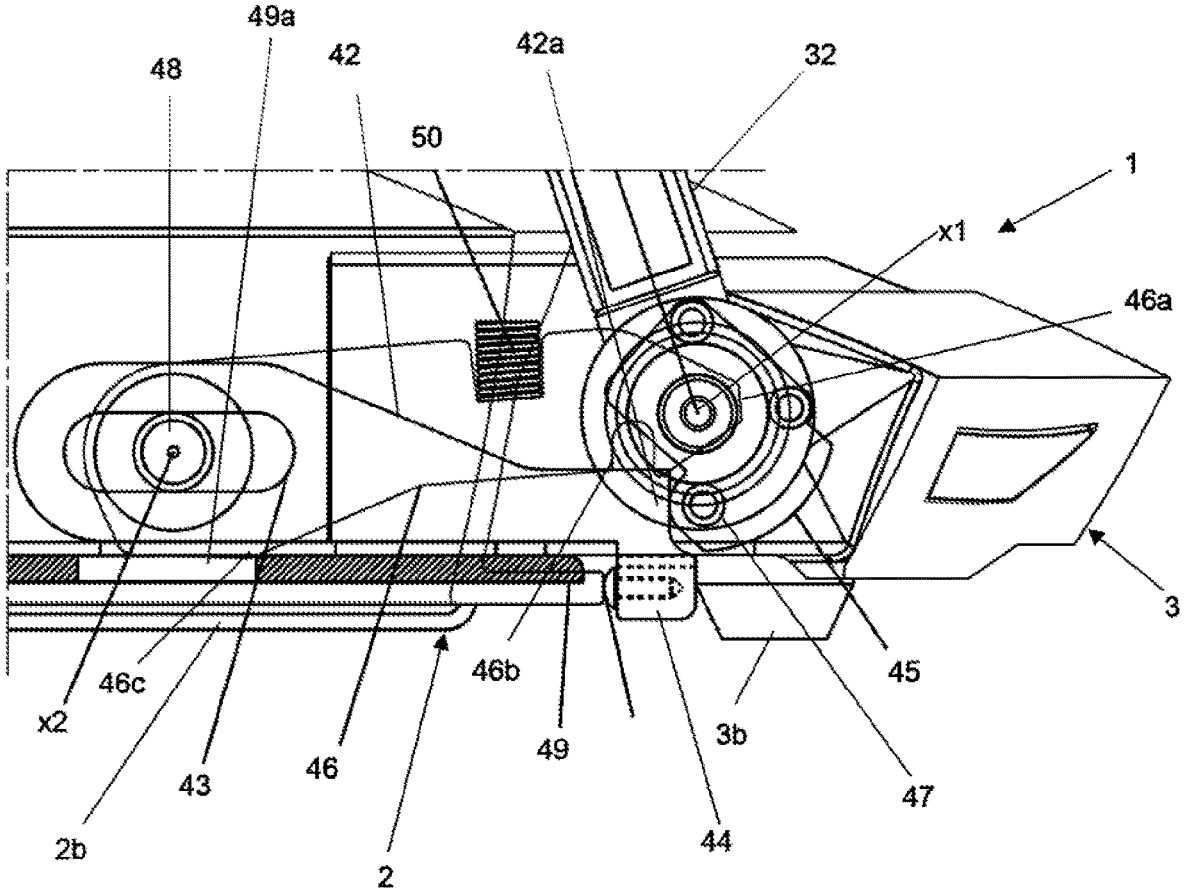
FIG. 7 is a side elevation view of the gangway of FIG. 1, with the distal gangway element in an intermediate position close to the retracted terminal position and a distal stanchion in a partially lowered position.

When the distal gangway element 3 is almost completely retracted, the latching lever 46 returns in contact with the variable profile guide 49 which raises the latching lever 46, releasing the stop element 47 integral with the cam member 45. At the same time, the return bracket 42 comes into frontal contact with the distal end 2*b* of the proximal gangway element 2 which stops its movement, while the distal gangway element 3 continues to retract (FIG. 7). The return bracket 42 pushes on the cam member 45 causing the distal stanchion 32 to rotate downwards and overcome the force of the torsional spring 41. At the end of the return of the distal gangway element 3, the initial condition represented in FIG. 1 applies.

It is understood that the invention is not limited to the embodiment described and shown herein, but may be subject to modifications relating to the shape and arrangement of parts, design and operating details, according to the numerous possible variants that will appear appropriate to those skilled in the art, and which are to be understood as included within the scope of protection as described and claimed herein.

What is claimed is:

1. A gangway comprising a proximal gangway element and a distal gangway element inserted into the proximal gangway element and slidable in a telescopic manner relative thereto, between a retracted terminal position and an extended terminal position, a distal stanchion hinged at a distal end of the distal gangway element, said distal stanchion being rotatable relative to the distal gangway element between a lowered terminal position and a raised terminal position, and a distal stanchion control mechanism configured to convert a sliding motion of the distal gangway element into a rotational motion of the distal stanchion, wherein the distal stanchion control mechanism comprises elastic means associated to the distal stanchion and configured to bias the distal stanchion from the lowered terminal position towards the raised terminal position, a return bracket mounted to the distal gangway element for a sliding motion between a proximal terminal position and a distal terminal position relative to the distal gangway element, and a cam member rotationally integral with the distal stanchion and configured to engage the return bracket by action of said elastic means, in such a way that the return bracket is biased from the distal terminal position towards the proximal terminal position, and wherein when the distal gangway element is in the retracted terminal position, the return bracket is in abutment against a distal end of the proximal gangway element and in the distal terminal position relative to the distal gangway element, raising of the distal stanchion being caused by a motion of the distal gangway element relative to the return bracket.

2. The gangway of claim 1, wherein the return bracket is slidable along a direction parallel to a sliding direction of the proximal gangway element.

3. The gangway of claim 1, further comprising a latching lever hinged to the distal gangway element and associated to a stop element rotationally integral with the distal stanchion, said latching lever being controllable by driving means fixed to the proximal gangway element in such a way to engage the stop element at said lowered terminal position and raised terminal position of the distal stanchion, and release the stop element in intermediate positions between the lowered terminal position and the raised terminal position of the distal stanchion.

4. The gangway of claim 3, wherein the latching lever is biased against said driving means.

5. The gangway of claim 3, wherein the latching lever comprises a follower portion and the driving means comprise a variable profile guide, the follower portion of the latching lever cooperating with said variable profile guide to control the latching lever.

6. The gangway of claim from 3, wherein the return bracket and the latching lever are arranged beside each other in a direction of a rotation axis (x2) of the latching lever, and wherein the latching lever is hinged to the distal gangway element through a hinge pin arranged to pass through a slot formed into the return bracket.

7. The gangway of claim 6, wherein the cam member and the stop element are arranged offset to each other in the direction of a rotation axis (x1) of the distal stanchion.

* * * * *